US005873463A

United States Patent [19]

Purcell

[11] Patent Number: 5,873,463

[45] Date of Patent: Feb. 23, 1999

[54] TOOL BOX

[76] Inventor: Stephen Purcell, 2071 NE. 44 St., Lighthouse Point, Fla. 33064

[21] Appl. No.: 941,684

[22] Filed: Sep. 30, 1997

[51] Int. Cl.[6] ..... B65D 43/16

[52] U.S. Cl. ..... 206/372; 220/4.22; 312/902

[58] Field of Search ..... 43/54.1; 206/315.11, 206/372, 373, 579; 220/4.22, 6, 7, 23.4; 312/109, 902

[56] References Cited

U.S. PATENT DOCUMENTS

| | | | |
|---|---|---|---|
| 258,814 | 5/1882 | Scott | 312/902 |
| 2,251,753 | 8/1941 | Newton | 312/902 |
| 2,697,460 | 12/1954 | Barnett | 312/902 |
| 3,148,811 | 9/1964 | Foltz | 43/54.1 |
| 4,240,222 | 12/1980 | Covington | 206/315.1 |
| 4,303,158 | 12/1981 | Perkins | 206/373 |
| 4,550,828 | 11/1985 | Baldwin et al. | 206/349 |
| 4,714,158 | 12/1987 | Oltman et al. | 206/349 |
| 4,865,194 | 9/1989 | Decarie | 206/378 |
| 4,951,812 | 8/1990 | Chen | 206/373 |
| 5,054,669 | 10/1991 | Zimbardi et al. | 43/54.1 |
| 5,332,305 | 7/1994 | Silvon et al. | 312/328 |
| 5,366,071 | 11/1994 | Laszlo | 206/373 |
| 5,512,165 | 4/1996 | Liu | 206/234 |
| 5,676,240 | 10/1997 | Cziraky et al. | 206/373 |

FOREIGN PATENT DOCUMENTS 7807392 1/1980 Netherlands .

*Primary Examiner*—Jim Foster
*Attorney, Agent, or Firm*—Harvey Lunenfeld

[57] ABSTRACT

A tool box in which tools, hardware, parts, and the like stored therein can be displayed, accessed, and retrieved in a quick, convenient, and efficient manner. Tools, hardware, and the like can be displayed and distinguished one from the other, accessed, removed, and stored quickly, and easily. The tool box has mating hinged container portions and mating hinged cover portions that may be pivotally opened for display, access, and retrieval of tools, hardware, and the like stored therein in a quick, convenient, and efficient manner and distinguished one from the other, accessed, removed, and stored quickly, and easily or closed for storage and transport, and display storage cases that may be removably and pivotally adjoined one to the other. The tool box is durable, light weight, inexpensive, safe to use, attractive, sturdy, and of simple construction, and may be of metal, such as aluminum or steel, thermoplastics, thermosetting polymers, rubber, or other suitable material or combination thereof.

25 Claims, 7 Drawing Sheets

TOOL BOX

BACKGROUND OF THE INVENTION

1. Field of the Invention

The present invention relates generally to tool boxes and more particularly to hinged tool boxes for tools, hardware, and the like.

2. Background Art

Tool boxes for storage of tools, hardware, and the like have been known. Tool boxes are generally of substantially rectangular construction and have a lower container for storage of the tools, an upper tray for storage of small parts, a cover with a latch to fasten the cover to the lower container, and a handle for carrying the tool box during transport. Such tool boxes allow for storage of tools in the lower container, small parts in the upper tray, and hardware in either or both the lower container and the upper tray. The tools, the hardware, and the small parts are generally placed one on top of the other, resulting in certain items being hidden from view and requiring digging to obtain the desired items of interest. As such, it is often difficult to find and retrieve the desired items of interest quickly, making search and retrieval of the tools, the hardware, and the small parts often a time consuming and frustrating task. There is thus a need for a tool box that allows for display, access, and retrieval of tools, hardware, parts, and the like, in a quick, convenient, and efficient manner. Tools should be capable of being displayed and distinguished one from the other and being accessed, removed, and stored quickly, and easily.

Different tool boxes have heretofore been known. However, none of the tool boxes adequately satisfies these aforementioned needs.

U.S. Pat. No. 4,550,828 (Baldwin et al.) discloses a portable tool box having an open-top, box-like housing containing removable slats with apertures for holding tools in an upright position and a drawer slidably engaged within a drawer aperture in one wall of the housing. The drawer outer wall has an outwardly projecting shelf and a lip extending above the shelf. A cover disposed over the housing has an end wall which covers the lip for retaining the drawer in the housing. The shelf extends around the perimeter of the housing for supporting a bottom edge of one or more of the walls of the cover.

U.S. Pat. No. 5,332,305 (Silvon et al.) discloses a tool box with a sliding tool storage pallet, which may be moved manually or mechanically when opening a lid to expose tools clipped to the pallet and contents of the tool box. The tool box has a peg board pallet with handles for manually moving the pallet into an upright inclined position after the lid has been opened, which may also be mechanically linked to the lid, in another embodiment, such that as the lid is opened, the pallet slides form a closed position to the upright position. Tools may be stored on the pallet by the use of known clips.

U.S. Pat. No. 4,303,158 (Perkins) discloses a tool box for small hand tools and associated items, which opens from the front and top and has a shelf having holes for holding certain tools upright. The tool box has a front cover, which is hingedly connected at a bottom edge to a front plate and has a strip magnet on an inside surface for mounting metal tools, a storage compartment, and a top cover, which is hingedly connected at a back edge to the back wall of the tool box.

U.S. Pat. No. 4,865,194 (Decarie) discloses a socket wrench tool box having a case and a lid to be mounted over the case for individually retaining sockets for a socket wrench. The case has two opposite side walls and a bottom wall, with two spaced parallel rotatable shafts carried by the side walls spaced over the bottom wall. Each shaft has two rows of radial stems, which are adapted to be releasably engaged by a plurality of similar yet differently dimensioned sockets form a socket wrench.

Netherlands Patent No. NL 7807392 (Schucom B.V.) discloses a tool box having a box shaped base portion with bottom walls and upright tapered extended walls perpendicular to the bottom walls. The tool box has two identical lids hinged to the bottom walls having carrying handles, for carrying the tool box when the lids are shut against the upright tapered walls. The upright tapered walls have fixing devices for one or more removable tool mountings.

U.S. Pat. No. 5,512,165 (Liu) discloses a personal tool box having a base frame with a clip at a back side of the base frame for hanging the tool box on a user's belt and vertically aligned tool rest holes for resting a hand tool, two pivots vertically connected to the base frame in parallel, pairs of bit carriages, socket carriages, storage cases, respectively turned about the pivots at different elevations for holding tool bits, sockets, and accessories.

U.S. Pat. No. 4,714,158 (Oltman et al.) discloses a removable tool tray assembly for use in a tool chest, including a tray member, a rotatable, lockable handle attached to the tray member, and a storage box adapted to rest in the tray member.

For the foregoing reasons, there is a need for a tool box that allows for display, access, and retrieval of tools, hardware, parts, and the like, in a quick, convenient, and efficient manner. Tools should be capable of being displayed and distinguished one from the other and being accessed, removed, and stored quickly, and easily. The tool box should be durable, light weight, inexpensive, safe to use, attractive, sturdy, and of simple construction.

SUMMARY

The present invention is directed to a tool box in which tools, hardware, parts, and the like stored therein can be displayed, accessed, and retrieved in a quick, convenient, and efficient manner. Tools, hardware, and the like can be displayed and distinguished one from the other, accessed, removed, and stored quickly, and easily. The tool box is durable, light weight, inexpensive, safe to use, attractive, sturdy, and of simple construction.

A tool box for tools, hardware, and the like having features of the present invention comprises: at least two hinged mating container portions, each of the hinged mating container portions hinged one to another of the hinged mating container portions; and at least two hinged mating cover portions, each of the hinged mating cover portions hinged to one of the hinged mating container portions.

DRAWINGS

These and other features, aspects, and advantages of the present invention will become better understood with regard to the following description, appended claims, and accompanying drawings where:

DESCRIPTION

Figure 1:
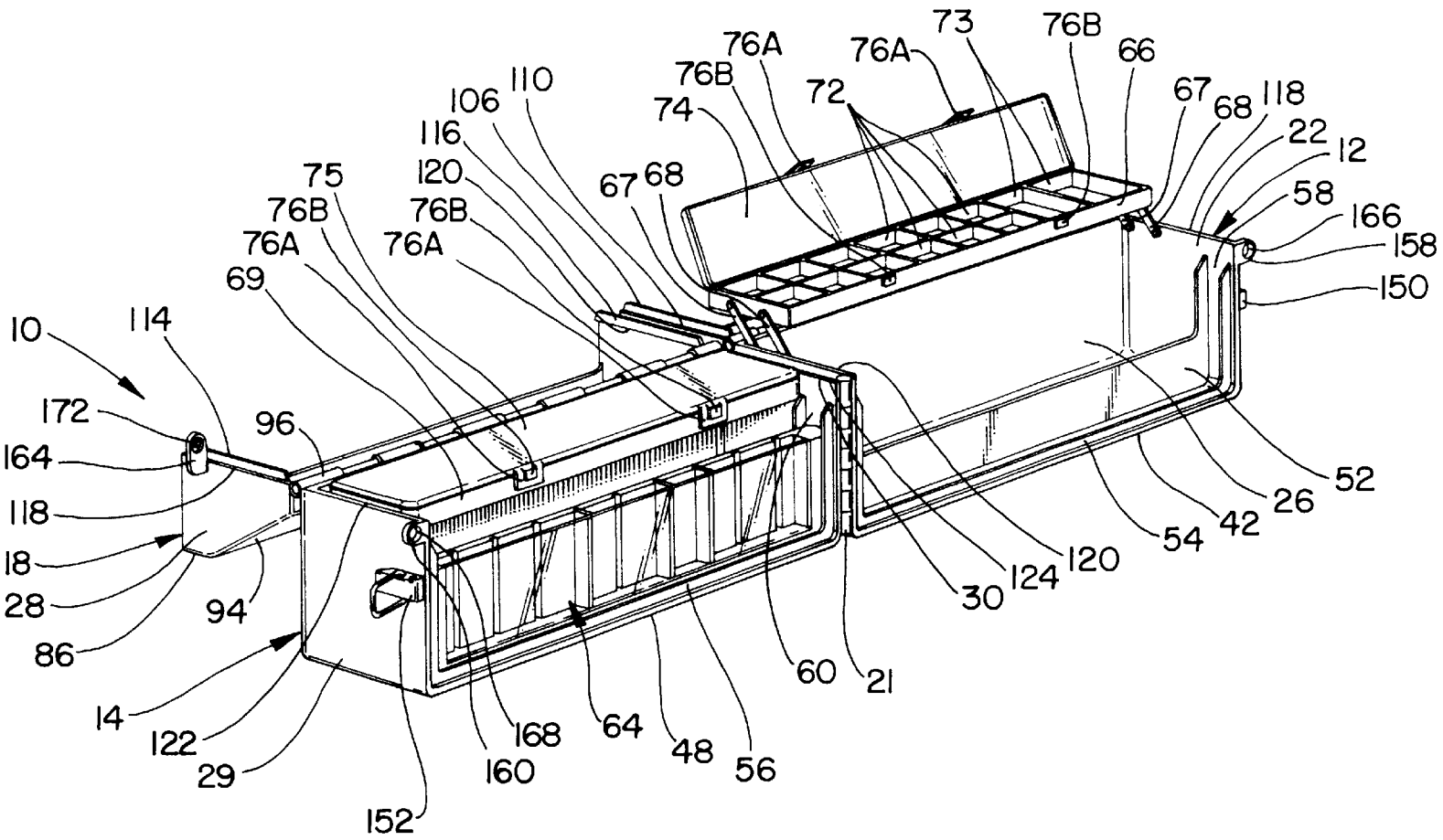
FIG. 1 is a perspective view of a tool box showing the tool box open, constructed in accordance with the present invention.
Figure 2:
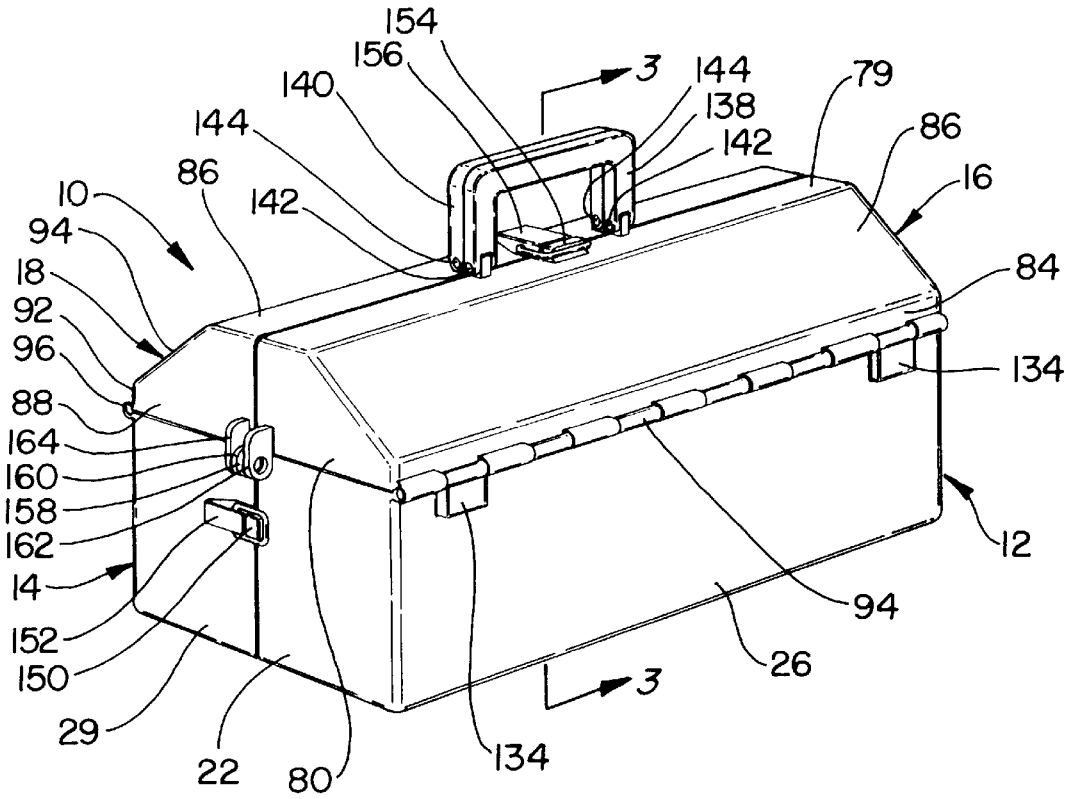
FIG. 2 is a perspective interior view of the tool box of FIG. 1 showing the tool box closed.
Figure 3:
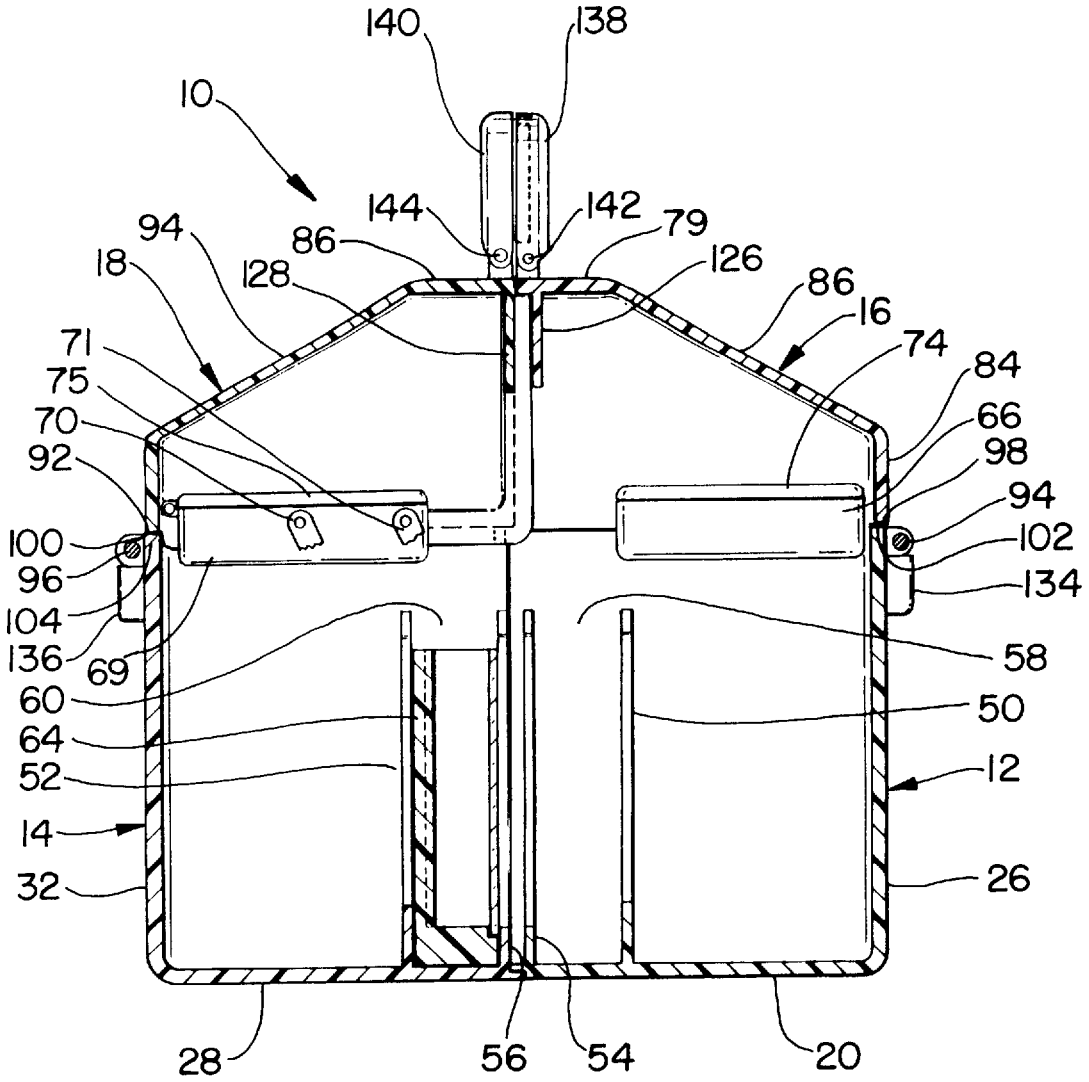
FIG. 3 is an end section view of the tool box of FIG. 1 with mating cover portions closed.
Figure 4:
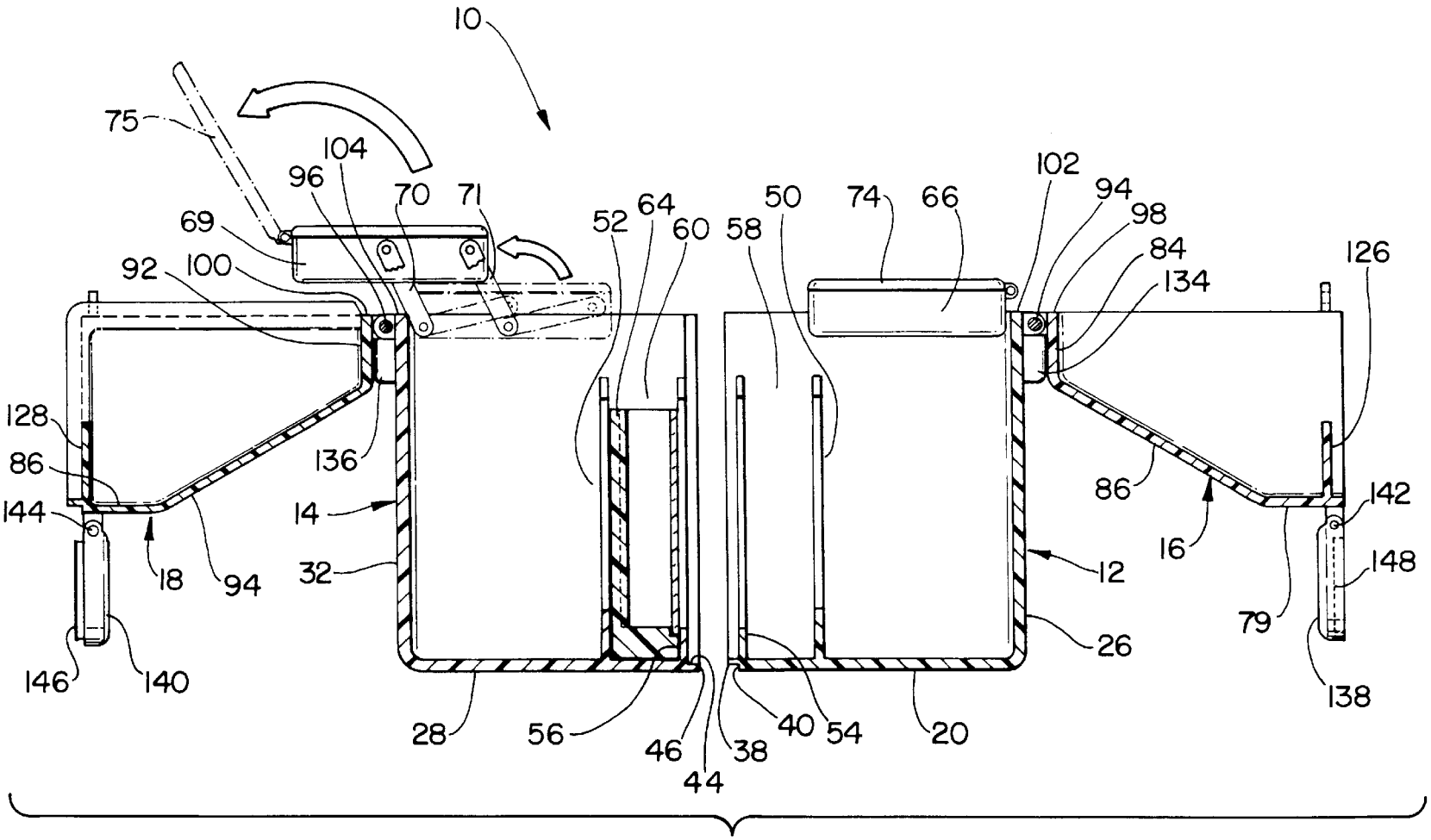
FIG. 4 is an end section view of the tool box of FIG. 1 with the mating cover portions open and mating container portions separated by removal of mating container portion hinge pin.
Figure 5:
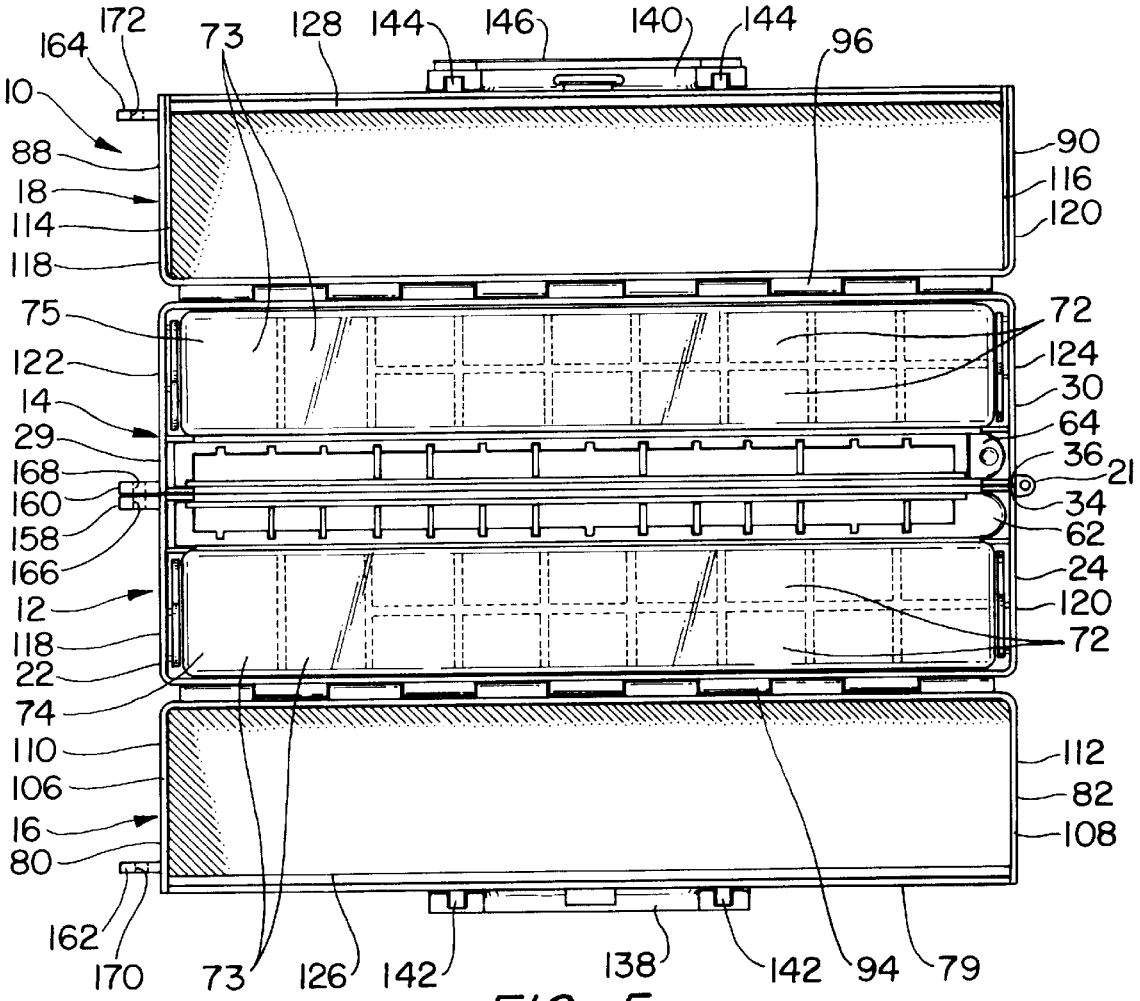
FIG. 5 is a top view of the tool box of FIG. 1 with the mating cover portions open.
Figure 6:
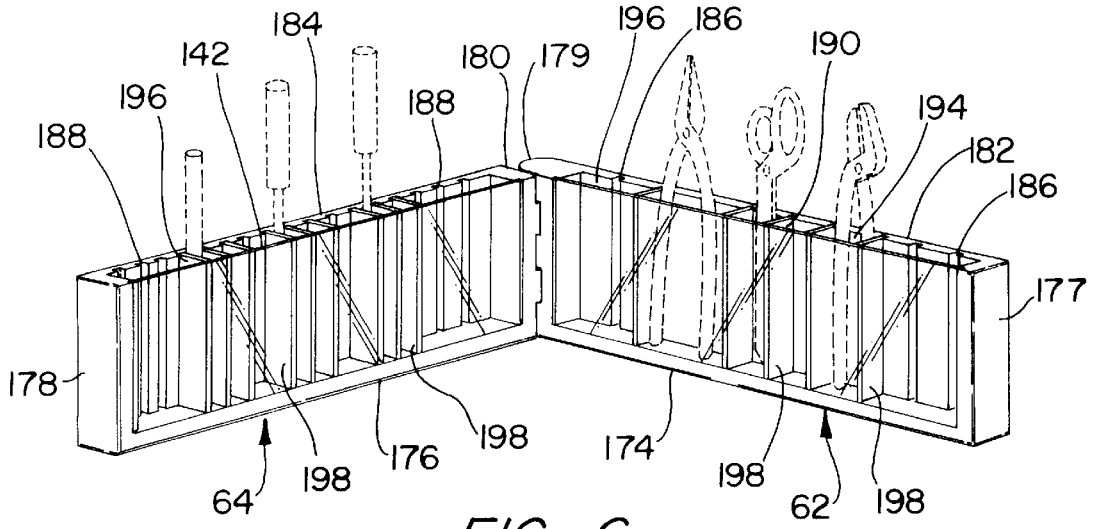
FIG. 6 is a perspective view of display storage cases of the tool box of FIG. 1 removed from the tool box and adjoined one to the other.

The preferred embodiments of the present invention will be described with reference to FIGS. 1–9 of the drawings. Identical elements in the various figures are identified with the same reference numbers.

FIGS. 1–5 show an embodiment of the present invention, a tool box 10 for tools, hardware, and the like having hinged mating container portions 12 and 14 and hinged mating cover portions 16 and 18. The mating container portion 12 has bottom 20, opposing end walls 22 and 24, and side wall 26, and the mating container portion 14 has bottom 28, opposing end walls 29 and 30, and side wall 32. The mating container portions 12 and 14 are hinged each to the other by hinge 21 at side edges 34 and 36 of the end walls 22 and 29 of the mating container portions 12 and 14, respectively.

The mating container portion 12 has inner male lip 38 and outer female receiving lip 40, respectively, each along interior side perimeter edge 42 of the bottom 20 and the opposing end walls 22 and 24 of the mating container portion 12, and the mating container portion 14 has inner female receiving lip 44 and outer male lip 46, respectively, each along interior side perimeter edge 48 of the bottom 28 and the opposing end walls 29 and 30 of the mating container portion 14 matingly, separatingly adjoining and sealing the mating container portions 12 and 14 each to the other when the mating container portions 12 and 14 are closed and abutted one to the other. The inner male lip 38 of the container portion 12 and the inner female receiving lip 44 of the container portion 14 abut one to the other, and the outer female receiving lip 40 of the container portion 12 and the outer male lip 46 of the container portion 14 abut one to the other, forming a seal therebetween the mating container portions 12 and 14 when the mating container portions 12 and 14 are closed and abutted one to the other.

The mating container portions 12 and 14 have partition portions 50 and 52, respectively, which are indented from and perpendicular to the interior side perimeter edges 42 and 48, respectively, and raised edges 54 and 56 at and perpendicular to the perimeter edges 42 and 48, respectively, spaced to form tracks 58 and 60. The tracks 58 and 60 are formed therebetween the partition portion 50 and the raised edge 54 and the partition portion 52 and the raised edge 56, respectively.

The tool box 10 has display storage cases 62 and 64, which may be removably inserted and stored therein the tracks 58 and 60, respectively for storage and display of tools, hardware, and the like. The partition portions 50 and 52 also prevent tools, hardware, and the like stored therebetween the partition portions 50 and 52 and the side walls 26 and 32, respectively from falling out of the mating container portions 12 and 14, upon removal of the display storage cases 62 and 64, respectively, when the mating container portions 12 and 14 are hingedly opened one from the other.

Additional optional partitions and tracks (not shown) may be added to the mating container portions 12 and 14 for storage and display of additional tools, hardware, and the like and removably inserting and storing additional display storage cases (not shown).

The tool box 10 has trays 66 hingedly mounted to the opposing end walls 22 and 24 of the mating container portion 12 with hinged members 67 and 68 and tray 69 hingedly mounted to the opposing end walls 29 and 30 of the mating container portion 14, with hinged members 70 and 71, respectively, so as to allow the trays 66 and 69 to be hingedly lifted to upper positions from lowered storage positions for easy access to stored tools, hardware, and the like. The trays 66 and 69 have compartments 72 and 73 for storing small tools, hardware, and the like, hinged lids 74 and 75, and latches 76A and 76B for securing tools, hardware, and the like in the compartments 72 and 73.

The mating cover portion 16 has top portion 79 opposing end walls 80 and 82, side wall portion 84, and sloping wall 86 between the top portion 79 and the side wall portion 84, and the mating cover portion 18 has top portion 86, opposing end walls 88 and 90, side wall portion 92, and sloping wall 94 between the top portion 86 and the side wall portion 92. The mating cover portions 16 and 18 may alternatively be of substantially rectangular construction having opposing end walls, side wall, and top wall.

The mating cover portions 16 and 18 are hinged to the container portions 12 and 14, respectively by hinges 94 and 96, respectively at lower edges 98 and 100 of the side wall portions 84 and 92 of the mating cover portions 16 and 18, respectively and at upper edges 102 and 104 of the side wall portions 26 and 32 of the mating container portions 12 and 14, respectively.

The mating cover portion 16 has inwardly overlapping lips 106 and 108 on lower edges 110 and 112, respectively of the opposing end walls 80 and 82 of the mating cover portion 16, and the mating cover portion 18 has inwardly overlapping lips 114 and 116 on lower edges 118 and 120, respectively of the opposing end walls 88 and 90 of the mating cover portion 18. The inwardly overlapping lips 106 and 108 and the inwardly overlapping lips 114 and 116 matingly, separatingly adjoin and seal the mating cover portion 16 and 18 to the mating container portions 12 and 14 at upper edges 118 and 120 of the opposing end walls 22 and 24 of the mating container portion 12 and upper edges 122 and 124 of the opposing end walls 29 and 30 of the mating container portion 14, when the mating cover portions 16 and 18 are closed and abutted to the container portions 12 and 14.

The mating cover portions 16 and 18 have interior partition portions 126 and 128 on and perpendicular to the top portions 79 and 86 of the mating cover portions 16 and 18, respectively, which prevent tools, hardware, and the like placed in the mating cover portions 16 and 18 from falling out of the mating cover portions 16 and 18, respectively, when the mating cover portions 16 and 18 are opened from the mating container portions 12 and 14. Optional latching hinged lids (not shown) may be hingedly placed between the interior partition portions 126 and 128 and the side wall portions 84 and 92 of the mating cover portions 16 and 18, respectively for storage of additional tools, hardware, and the like. The mating container portions 12 and 14 have bumper stops 134 and 136 on the side walls 26 and 32 of the mating container portions 12 and 14, respectively for maintaining the mating cover portions 16 and 18 in a level position, when the mating cover portions 16 and 18 are opened from the mating container portions 12 and 14.

The tool box 10 has mating handles 138 and 140 hingedly adjoined to the mating cover portions 16 and 18 by hinges 142 and 144 for a user to carry the tool box 10. The mating handle 140 has male lip 146, and the mating handle 138 has female receiving portion 148 for matingly receiving the male lip 146, when the mating handles 140 and 138 are abutted one to the other.

The mating container portions 12 and 14 have latch portions 150 and 152, respectively for fastening the mating container portions 12 and 14 one to the other, and the mating cover portions 16 and 18 have latch portions 154 and 156, respectively for fastening the mating cover portions 16 and 18 one to the other for storage and transport.

The mating container portions 12 and 14 have tabs 158 and 160, respectively, and the mating cover portions 16 and 18 have tabs 162 and 164, respectively, each of the tabs the tabs 158, 160, 162, and 164 aligned one to the other. Each of the aligned tabs have aligned holes 166, 168, 170, and 172 aligned one to the other for placement of a padlock shaft therethrough and locking the tool box 10 for security purposes.

Figure 7:
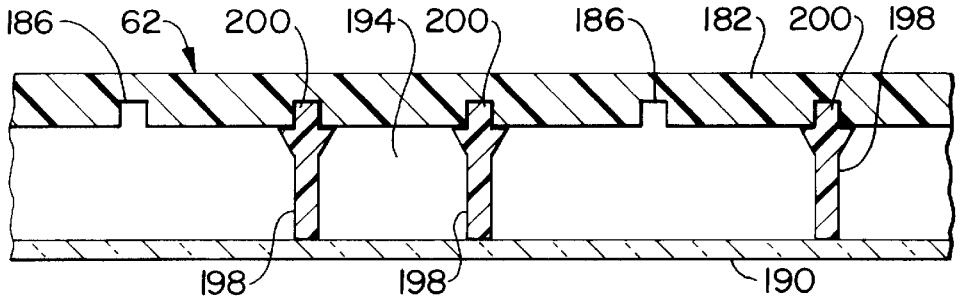
FIG. 7 is a top section view of one of the display storage cases of FIG. 6.
Figure 8:
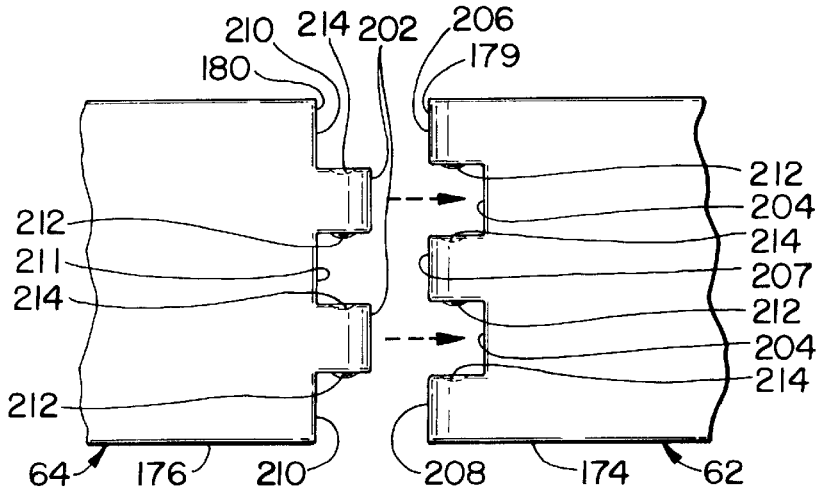
FIG. 8 is a front view of hinge portions of the display storage cases of FIG. 6.
Figure 9:
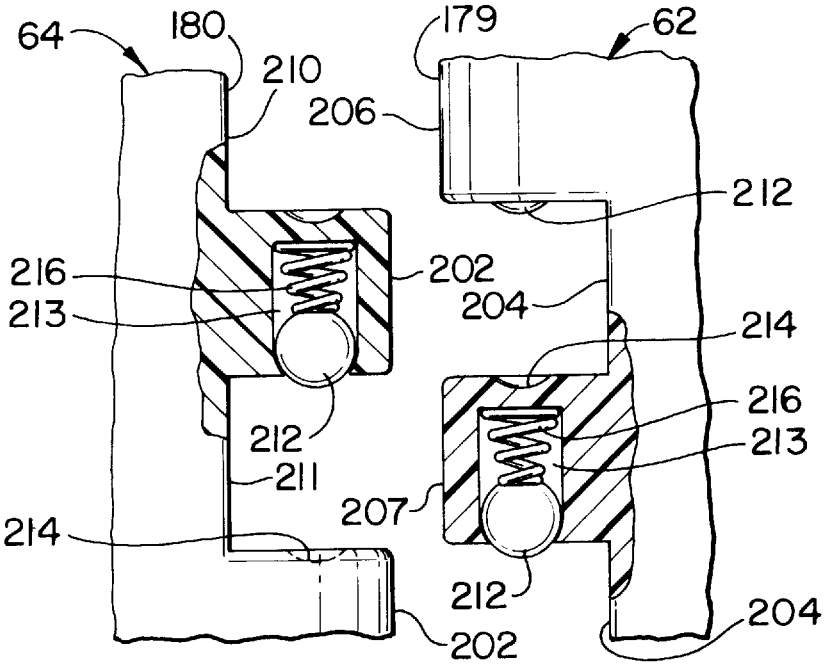
FIG. 9 is a breakout view of the hinge portions of the display storage cases of FIG. 8.

The display storage cases 62 and 64 are shown in more detail in FIGS. 7–9. The display storage cases 62 and 64 have bottoms 174 and 176, outside end walls 177 and 178, hinged convex mating end walls 179 and 180, back walls 182 and 184 having slots 186 and 188, and front walls 190 and 192, which may be optionally and preferably transparent for viewing tools, hardware, and the like placed in compartments 194 and 196 of the display storage cases 62 and 64, respectively.

Removable T shaped partitions 198 having heads 200 are removably placed in the display storage cases 62 and 64 with the heads 200 in the slots 186 and 188 and form the compartments 194 and 196 between the back walls 182 and 184, the front walls 190 and 192, and the partitions 198, respectively. The size of the compartments 194 and 196 may be varied for different size tools, hardware, and the like, by adding or removing one or more of the partitions 198. The hinged convex mating end walls 179 and 180 have interleaved tongues 202 on the hinged convex mating end wall 180, which interleave with grooves 204 of the hinged convex mating end wall 179 and interleaved tongues 206, 207, and 208 on the hinged convex mating end wall 179, which interleave with grooves 210 and 211 on the hinged convex mating end wall 180.

Partially protruding spring loaded spheres 212, which protrude from the tongues 202, 206, and 207 having cavities 213 rest in cups 214 of the tongues 202, 207, and 208, when the display storage cases 62 and 64 are adjoined one to the other. Springs 216 allow the spring loaded spheres 212 to be depressed into the cavities 213, so that the display storage cases 62 and 64 can be separated one from the other for storage in the tracks 58 and 60 or adjoined one to the other, and the hinged convex mating end walls 179 and 180 allow the adjoined display storage cases 62 and 64 to be pivoted one about the other for display, storage, and convenience of the user.

The mating container portions 12 and 14 and the mating cover portions 16 and 18 may be pivotally opened for display, access, and retrieval of tools, hardware, and the like stored therein in a quick, convenient, and efficient manner and distinguished one from the other, accessed, removed, and stored quickly, and easily or closed for storage and transport.

The tool box 10 may optionally have two or more mating container portions and two or more mating cover portions and may be rectangular or other than rectangular construction.

The hinges 21, 94, and 96 may have a hinge pin, as in a standard hinge, allowing the hinged mating container portions 12 and 14 and the hinged mating cover portions 16 and 18 to be removably attached one from the other, or the hinges 21, 94, and 96 may alternatively be living hinges.

The tool box 10 may be of metal, such as aluminum or steel, thermoplastics, thermosetting polymers, rubber, or other suitable material or combination thereof. The front walls 190 and 192 of the display storage cases 62 and 64 are preferably of transparent thermoplastics or thermosetting polymers.

Although the present invention has been described in considerable detail with reference to certain preferred versions thereof, other versions are possible. Therefore, the spirit and scope of the appended claims should not be limited to the description of the preferred versions contained herein.

What is claimed is:

1. A tool box for tools, hardware, and parts, comprising:

at least two hinged mating container portions, each said mating container portion having an opening edge, said edges defining a single common opening when said mating container portions are pivoted side by side, each said hinged mating container portion hinged one to another said hinged mating container portion; and at least two hinged mating cover portions, said mating cover portions adapted to cover said opening, each said hinged mating cover portion hinged to one each said hinged mating container portion.

2. The tool box according to claim 1, wherein each said mating container portion has a bottom, opposing end walls, and a side wall.

3. The tool box according to claim 2, wherein each said mating cover portion has a top, opposing end walls, and a side wall.

4. The tool box according to claim 2, wherein each said mating cover portion has a top portion, opposing end walls, a side wall portion, and a sloping wall between said top portion and said side wall portion.

5. The tool box according to claim 1, wherein at least two said mating container portions have mating latch portions for fastening said mating container portions one to the other.

6. The tool box according to claim 1, wherein at least two said mating cover portions have mating latch portions for fastening said mating cover portions one to the other.

7. The tool box according to claim 1, wherein at least two said mating container portions and at least two said mating cover portions have tabs adjoined thereto and each of said tabs have holes aligned one to the other for placing securing means therethrough.

8. The tool box according to claim 1, wherein at least two said mating cover portions have mating handles and each said mating handle is hingedly attached to one said mating cover portion.

9. The tool box according to claim 1, wherein further said hinged mating container portions hinged one to another are removably hinged and said hinged mating cover portions hinged to said hinged mating container portions are removably hinged.

10. The tool box according to claim 1, wherein at least one said mating container portion has a tray having at least one compartment, each said tray hinged to said mating container portion.

11. The tool box according to claim 10, wherein each said tray has a hinged lid.

12. The tool box according to claim 11, wherein each said tray and each said hinged lid have latch portions for securing said hinged lid to said tray.

13. The tool box according to claim 1, wherein said mating container portions have matingly opposing male and female lips for matingly sealing said container portions one to the other when said mating container portions are abutted one to the other.

14. The tool box according to claim 1, wherein said mating cover portions have matingly overlapping lips overlapping said mating container portions for matingly sealing said mating cover portions to said mating container portions when said mating cover portions and said mating container portions are abutted one to the other.

15. The tool box according to claim 1, wherein at least one said mating container portion has at least one display storage case for tools, hardware, and parts.

16. The tool box according to claim 1, wherein at least one said mating container portion has at least one partition portion and a wall forming a track therebetween, wherein further when said mating container portion has more than one said partition portion, said partition portions form tracks therebetween, said partition portions additionally for separatingly storing selected tools, hardware, and parts within said mating container portions and preventing said tools, hardware, and parts stored therein said mating container portions from falling out of said mating container portions when said mating container portions are opened one from the other.

17. The tool box according to claim 16, wherein said tool box has at least one removable display storage case for tools, hardware, and parts therein at least one said track.

18. The tool box according to claim 16, wherein at least one said mating container portion has a raised edge forming a track therebetween said raised edge and one said partition portion.

19. The tool box according to claim 18, wherein said tool box has at least one removable display storage case for tools, hardware, and parts therein at least one said track.

20. The tool box according to claim 15, wherein said display storage case has hinged mating end walls.

21. The tool box according to claim 15, wherein said display storage case has removable partitions.

22. The tool box according to claim 15, wherein said display storage case has a transparent front wall.

23. The tool box according to claim 20, wherein said hinged mating end walls are of interleaved tongue and groove, selected said tongues having spring loaded spheres depressed into receiving cups of mating said tongues.

24. The tool box according to claim 20, wherein at least one said hinged mating end wall is convex.

25. The tool box according to claim 1, wherein said tool box is constructed of materials from the group consisting of metals, thermoplastics, thermosetting polymers, and rubber.

* * * * *